United States Patent [19]

Bolen

[11] 4,423,784

[45] Jan. 3, 1984

[54] VEHICLE FIRE EXTINGUISHER

[75] Inventor: Ralph A. Bolen, London, Ohio

[73] Assignee: John Sawyer, Cincinnati, Ohio

[21] Appl. No.: 261,262

[22] Filed: May 6, 1981

[51] Int. Cl.[3] ..... A62C 35/12

[52] U.S. Cl. ..... 169/62; 222/3; 280/727

[58] Field of Search ..... 169/62, 56, 26, 19, 169/54, 30; 222/3, 52, 500, 5; 137/38, 39; 280/734, 735, 728, 727; 180/282

[56] References Cited

U.S. PATENT DOCUMENTS

| | | | |
|---|---|---|---|
| 2,385,825 | 10/1945 | Mathisen | 169/62 |
| 3,387,662 | 6/1968 | Molgano, Jr. | 169/26 |
| 3,392,787 | 7/1968 | Weise | 169/26 |
| 3,500,750 | 3/1970 | Vohl | 137/38 |
| 3,515,218 | 6/1970 | Gardner et al. | 169/62 |
| 3,653,684 | 4/1972 | Plumer | 280/734 |
| 3,656,665 | 4/1972 | Fleming et al. | 222/500 |
| 3,706,463 | 12/1972 | Lipkin | 137/38 |
| 3,820,607 | 6/1974 | Miley | 222/5 |

FOREIGN PATENT DOCUMENTS

| | | | |
|---|---|---|---|
| 375438 | 6/1932 | United Kingdom | 169/56 |

*Primary Examiner*—Joseph J. Rolla
*Assistant Examiner*—Kenneth Noland
*Attorney, Agent, or Firm*—King and Liles

[57] ABSTRACT

A vehicle fire extinguisher is provided which discharges a copious supply of fire retardant into the engine compartment and in the vicinity of the fuel tank of the vehicle in response to a vehicle crash. The fire retardant deprives the areas of the vehicle most susceptible to fire of oxygen needed for combustion and fire development.

9 Claims, 2 Drawing Figures

VEHICLE FIRE EXTINGUISHER

The present invention relates generally to fire extinguishers and more particularly concerns a fire extinguisher for a vehicle that is operatively responsive to impact of the vehicle. The invention will be specifically disclosed in connection with an automobile fire extinguisher that discharges a copious amount of fire retardant to either the engine compartment or the fuel tank whenever the automobile is involved in either a front end or rear end collision.

Each year many deaths result from automobile accidents. In many cases the deaths are the direct result of impact of the automobile. In other cases, however, deaths or injuries result from fires that occur as a consequence of the impact. The likelihood of a fire following a collision of an automobile or other vehicle is great when the vehicle is propelled by an internal combustion or other type of engine that requires highly combustible fuel. An internal combustion engine inherently generates heat and either this heat or heat generated by the impact itself may be sufficient to establish a fire if either the fuel tank or a fuel line is ruptured during a collision.

It is particularly important to take fire preventive measures in the locations which fire is most likely to occur. As suggested above, following a front end collision of an automobile, the most likely place for a fire to occur is in the engine compartment. If, on the other hand, a rear end collision of an automobile occurs, the most likely location for an ensuing fire is in the vicinity of a fuel tank (assuming, as is frequently the case, that the fuel tank is near the rear end of an automobile). Front and rear end collisions are the most frequently occurring collisions.

It may thus be seen that it is particularly desirable to inhibit fire development in certain specified locations whenever a collision of a vehicle occurs. In an automobile, for example, it is particularly desirable to inhibit fire development in the engine compartment and in the vicinity of the fuel tank.

The present invention provides a means of so inhibiting fire development in specified locations in response to specified types of impact. The present invention also has the capability for manual activation to retard or inhibit fires resulting from causes other than impact.

It is thus an object of the present invention to provide an apparatus for inhibiting fire at a specific location of a vehicle.

It is a further object of the present invention to provide an apparatus for inhibiting fire in a vehicle as a result of a collision.

It is another object of the present invention to provide an apparatus to sense impact of the vehicle from a predetermined location and to selectively inhibit fire at locations determined by the direction of the sensed impact.

It is yet another object of the present invention to inhibit fire development conditions at locations of a vehicle which are likely to develop fire after a crash and to establish those nonfire conditions in response to a collision of the vehicle.

It is a further object of the present invention to surround the vicinity of an engine or a fuel tank of a vehicle with fire retardant whenever a vehicle is involved in a crash.

SUMMARY OF THE INVENTION

In accordance with the invention, a vehicle is provided with a fire extinguisher. The fire extinguisher includes a container for fire retardant which is carried by the vehicle. Means are provided which sense impact of the vehicle as well as which respond to said sensing means to release fire retardant in response to impact of the vehicle.

In accordance with another aspect of the invention, the container contains pressurized fire retardant which is selectively releasable through a valve, the responsive means being operative to open the valve and release fire retardant in response to impact of the vehicle.

According to another aspect of the invention, a housing is provided which is securely fixed to the vehicle with an inertial member movable therein which moves in response to a time rate of change of velocity of the housing. Preferably an actuator is attached to the inertial member for common movement therewith, the actuator being engagable with the valve to open the valve in response to movement of the inertial member relative to the vehicle.

Yet another aspect of the invention relates to supplying fire retardant to the engine compartment and fuel tank of a vehicle in response to impact of the vehicle.

In carrying out the invention, a fluid passage is provided from the container to a conduit for dispensing of the fire retardant through the housing and the inertial member.

According to a still further aspect of the invention, a manual control arm is secured to the housing and is operative to either move or prevent movement of the inertial member irrespective of the vehicle's time rate of change of velocity.

BRIEF DESCRIPTION OF THE DRAWINGS

Other objects and advantages of this invention will become apparent upon reading the following detailed description and upon reference to the drawings, in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE PREFERRED EMBODIMENT

Figure 1:
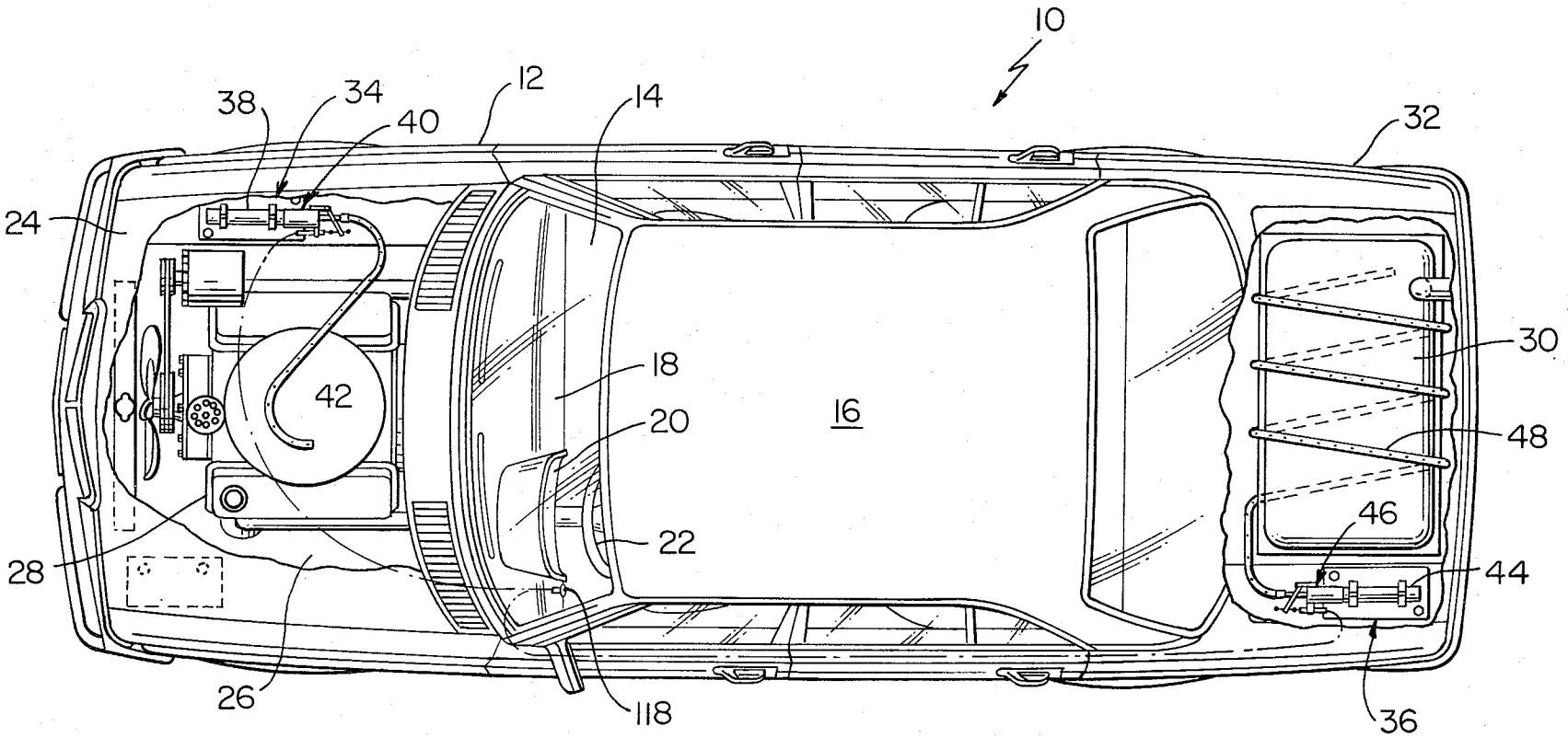
FIG. 1 is a plan view of an automobile with portions of the hood and trunk sections being cut away to illustrate a form of fire extinguishing system made in accordance with the present invention disposed in the engine compartment and about the fuel tank.

Referring now to the drawings and to FIG. 1 in particular, a vehicle in the form of an automobile is shown and generally designated by the numeral 10. The automobile 10 includes a body 12 which is carried by four wheels (not shown) in a conventional manner. The body 12 includes a passenger compartment 14 disposed beneath a roof 16, which passenger compartment 14 is designed to accommodate a driver and several nonoperating passengers. A dashboard 18 including a control panel 20 are shown in the illustration of FIG. 1. A steering wheel 22 for directing movement of the automobile 10 is also shown proximal to the control panel 20.

The front end 24 of the body 12 has an engine compartment 26 which houses an internal combustion engine 28. Fuel for the internal combustion engine 28 is supplied from a fuel tank 30 located in the rear end 32 of the automobile body 12. Two fire extinguishing systems 34 and 36 are located in the front end 24 (in the engine compartment 26) and rear end 32 respectively of the automobile body 12. The fire extinguishing system 34 has a canister 38 of pressurized fire retardant, an impact apparatus 40 and a closed ended perforated hose 42, the perforated hose 42 being connected to the canister 38 through the impact apparatus 40. The perforated hose 42 extends over the internal combustion engine 28.

Similarly, the fire extinguishing system 36 in the rear end of the automobile body 12 includes a canister 44 of fire retardant, an impact apparatus 46 and a perforated flexible hose 48. The perforated hose 48 is illustrated wrapped around the fuel tank 30.

Figure 2:
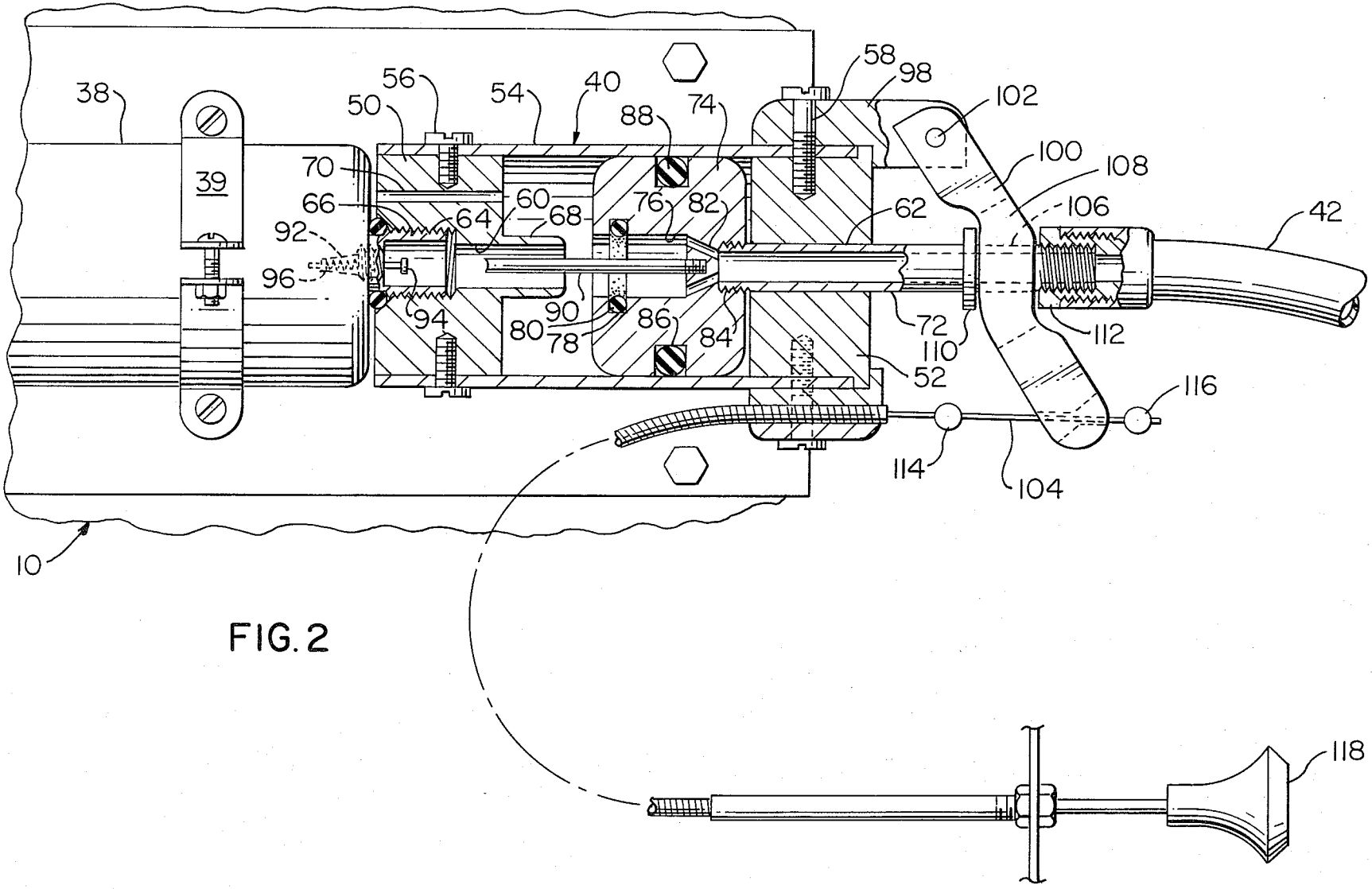
FIG. 2 is a fragmentary cross sectional elevational view, partially in cross section, of an impact apparatus depicting an inertial member and its relationship to an associated fire retardant canister and hose.

The canister 38, impact apparatus 40 and perforated hose 42 are shown more clearly and in greater detail in FIG. 2. In FIG. 2, it is seen that the impact apparatus 40 includes a housing of three primary components, two end components 50 and 52 which are disposed within a cylindrically shaped intermediate portion 54, which intermediate portion 54 spans the distance between the end components 50 and 52. As illustrated, these components are separate but rigidly connected. It should be readily apparent, however, that a single piece of material could be used for all three components. For purposes of description, end component 50 will be referred to as the first end component and end component 52 as the second end component. The end components 50 and 52 of the illustrated embodiment are secured within the cylindrical intermediate portion 54 through the agency of suitable fastening elements such as illustrated screws 56 and 58. The screws 56 and 58 extend through the intermediate portion 54 and the end components 50 and 52 respectively.

Each of the end illustrated components 50 and 52 is also cylindrically shaped with an axis coincident with the longitudinal axis of the intermediate portion 54. A first fluid passage 60 and an opening 62 extend through the end components 50 and 52, fluid passage 60 extending through the first end component 50 and opening 62 extending through the second end component 52. These fluid passages 60 and 62 are concentrically disposed about the respective axes of the end segments 50 and 52. The exterior axial end of end portion 50 is internally threaded at location 64 and threadably receives an exteriorally and matingly threaded nipple 66 of the compressed fire retardant canister 38. The opposite axial side of the fluid passage 60 terminates in a nipple 68 extending axially inward from the interior wall of end component 50. The first end component 50 also has a vent passage 70 providing constant fluid communication between the ambient air and the interior of the impact housing apparatus, adjacent and interior to the end component 50.

The second end component 52, at the opposite axial end of the impact apparatus housing, as noted above, has an opening 62 extending therethrough. This opening 62 receives a rigid reciprocally moving fluid conduit 72 which is threadably received on one end by an inertial member 74 and on the opposite end by a threadable connection to the flexible hose 42. This inertial member 74 is reciprocally axially movable with the intermediate portion 54 of the impact housing between the range defined by the end components 50 and 52.

The inertial member 74 also has a second fluid passage 76 coaxially aligned with the fluid passage 60 and opening 62 of the axial end components 50 and 52 of the impact apparatus housing. This fluid passage 76 extends completely through the inertial member 74. The left hand side (in the illustration) of the fluid passage 76 is enlarged (relative to the right hand side) and has an internal diametrical dimension slightly in excess of the external diametrical dimension of the nipple 68 extending axially inward from end component 50. Further, a cylindrical groove 78 about passage 76 accommodates an O-ring 80 to provide sealing relationship between the nipple 68 and the inertial member 74 when the former (68) is disposed within the latter (74). The fluid passage 76 diverges from the enlarged diameter (the left hand side in the depiction of FIG. 2) at an intermediate location 82 adjacent end component 52. The fluid passage 76 threadably receives the rigid conduit 72 at threaded end 84 adjacent location 82.

The exterior circumferential periphery of the inertial member 74 has an annular groove 86 into which an O-ring 88 is fitted. The O-ring 88 provides a sealing fit between the exterior circumferential periphery of the inertial member 74 and the interior circumferential surface of the impact apparatus housing, both during the period when the inertial member 74 is statically disposed with respect to the impact apparatus housing and during the period that the inertial member 74 is being slidingly advanced from the illustrated position (of FIG. 2) toward the axial end component 50.

FIG. 2 also shows an actuator in the form of a firing pin 90 centrally disposed within the fluid passage 76 and extending into nipple 68 and fluid passage 60. This firing pin 90 is securely fixed and attached to the inertial member 74 for common movement therewith. The fire retardant canister 38, which may contain carbon dioxide or any other fire retardant, has a spring bias valve 92, a stem 94 of which extends into nipple 68. When the nipple 68 is threadably advanced into and received by the fluid passage 60, the stem 94 is in alignment with the firing pin 90. If engaged and moved leftwardly (in the illustration) by the firing pin 90, the valve stem 94 is operative to unseat the closure member 96 of the valve 92, permitting pressurized gas within the canister 38 to be discharged therefrom.

Also rigidly attached to the housing is a bracket 98 which pivotally supports a manual control arm 100. The manual control arm 100 is pivotally connected at pivot point 102 to the bracket 98 on its one end and to a push-pull cable 104 on the opposite end, the connection to push-pull cable 104 being slidable. Intermediate of these two end sections, the manual control arm 100 is slidably connected to the rigid fluid conduit 72. The connection between the manual control arm 100 and the rigid fluid conduit 22 is achieved by way of a bore 106 extending through the manual control arm's intermediate portion 108. The rigid fluid conduit 72 is passed through the bore 108. End stops 110 and 112, disposed on the exterior of the rigid fluid conduit 72 on opposite sides of the sliding interface with the manual control arm limit the relative sliding between the manual control arm 100 and the rigid conduit 72. The range of sliding movement between the manual control arm 100 and the push-pull cable 104 is limited by a pair of lugs 114 and 116 which are secured to push-pull cable 104 at predetermined space locations from the control arm 100. The push-pull cable 104 is movable by the aid of a push-pull grip 118 attached to the end of the push-pull cable 104 opposite the connection with manual control arm 100.

In normal operation of the automobile 10, compressed fire retardant, such as carbon dioxide, is stored in each of the canisters 36 and 44 with the respective values (valve 92 associated with canister 36 and an identical but non-illustrated valve associated with canister 44) closed to prevent escape of the fire retardant. However, if the front end 24 of the automobile were subjected to a front end crash, the front end 24 of the body 12 would, in all likelihood, be subjected to a time rate of change of velocity.

The impact apparatus housing 54 is rigidly secured to a rigid structural component of the body (as, for example, by clamps 39 in FIG. 2) and experiences the same time rate of change of velocity as the body 12. The inertial member 74, however, is not rigidly attached to either the body 12 of the impact apparatus housing 54 and is slidable relative to the housing 54. Since the inertial member 74 is not rigidly attached to either the body 12 or the housing 54, the deacceleration of (or acceleration in the case of a rear end collision) that component (74) is equal to that of the body 12 only if the frictional forces acting upon the inertial member 74 are sufficient to match the inertial forces produced by that time rate of change of velocity upon the inertial member's 74 mass. However, the impact apparatus is designed to be lacking in sufficiently strong frictional forces to match the inertial forces resulting from a crash situation.

The impact apparatus 34 is oriented with the end component 50 and canister 38 toward the front of the automobile 10 so that a front end crash of the automobile 10 will advance the inertial member 74 toward the front of the automobile 10 (leftwardly as illustrated in FIG. 2). This leftward movement (toward the compressed lighter than air canister 38) forces the firing pin 90 into engagement with the valve stem 94, overcoming the spring bias of valve 92 in fire retardant canister 38 and unseating closure member 96. Vent passage 70 permits the escape of air within the space between inertial member 74 and the end portion 50 when the inertial member 74 is advanced toward end portion 50 to aid in achieving this result. Discharge of the pressurized fire retardant from canister 38 through the internal flow passages of the impact apparatus and perforated hose 42 to the engine compartment 26 results.

The leftward movement of the inertial member 74 (toward the canister 38) also results in the disposition of nipple 68 of the end component 50 within the fluid passage 76 with the O-ring 80 providing a sealing relationship between the nipple 68 and the fluid passage 76. This disposition of the nipple 68 within the fluid conduit 76 establishes a continuous internal sealed flow passage through the impact apparatus and between the canister 38 and the flexible perforated hosing 42. Thus, whenever the inertial member 74 is moved toward the canister 38 so as to cause firing pin 90 to unseat closure member 96 in the valve 92, the fire retardant within canister 22 is supplied via the flexible hosing 42 to the engine compartment 26. When this fire retardant is supplied to the engine compartment, it will deprive any fire at that location of the oxygen necessary for combustion, extinguishing any existing fire.

The fire extinguishing system 36 mounted in rear end 32 of the automobile 10 is orientated 180 degrees from fire extinguishing system 34 so as to be responsive to rear end collisions of the automobile 10. In other words, the fire retardant canister 44 is positioned to the rear of impact apparatus 46 and upon rear end impact of the automobile 10, the inertial member within the apparatus 36 (corresponding to inertial member 74 of fire extinguishing system 34) moves toward the rear of the automobile 10 to unseat a valve within the canister 44. Further, the perforated flexible hose 48 is wrapped around fuel tank 30 to flood the space surrounding the fuel tank 30 with fire retardant in response to a rear end crash. The fire retardant deprives the space surrounding tank 30 of the oxygen necessary to support combustion.

Each of the illustrated impact apparatuses also have a manual control arm. Once again, only fire extinguishing system 34 will be described. However, fire extinguishing system 36 is identical. In FIG. 2, a control arm 100 is shown which may be used to either activate or deactivate the system herein described. It may be desirable to deactivate the system under acceleration or deacceleration conditions otherwise sufficient to activate the system. The push-pull grip 118 is provided and may be pushed inwardly to advance lug 114 on push-pull cable 104 toward manual control arm 100. Lug 114 is firmly attached to push-pull cable 104 and limits the movement of both the manual control arm 100 and the inertial member 74. Thus, when the lug 114 is so advanced, activation of the disclosed apparatus will not occur even if the inertial member 74 is suddenly accelerated or deaccelerated.

Situations may also occur in which it is desirable to activate the disclosed system even though substantial impact of the automobile 10 has not occurred. One such example might include fire in the engine compartment 26 occurring for reasons other than impact. The pulling of the push-pull grip 118 advances the lug 116 on push-pull cable 104 toward and into engagement with the control arm 100. Continued movement of the push-pull grip 118 forces movement of the control arm 100 with the resultant movement of the inertial member 74 and its firing pin 90. Once the firing pin 90 is moved to unseat the valve 92, manual activation of the system results with a flooding of the engine compartment 26 (or fuel tank 30 vicinity) with the fire retarding contents of canister 38 (or canister 44).

Thus it is apparent that there has been provided, in accordance with the invention, an apparatus that satisfies the objects, aims and advantages set forth above. While the invention has been described in conjunction with a specific embodiment thereof, it is evident that many alternatives, modifications, and variations will be apparent to those skilled in the art in light of the foregoing description. It should, for example, be clear that the invention may be used on aircraft or any other type of vehicle. Accordingly, it is intended to embrace all such alternatives, modifications, and variations as fall within the spirit and broad scope of the appended claims.

What is claimed is:

1. In combination with a vehicle, a fire extinguisher operative in response to vehicle impact, comprising:

(a) a longitudinal housing secured to the vehicle, said housing having first and second end components, said first end component having a first fluid passage extending therethrough and being adapted to selectively communicate with a source of pressurized fire retardant;

(b) an inertial member disposed within said housing, said inertial member being reciprocally movable within a predetermined range from one of said first and second end components to the other in response to a time rate of change of velocity of the housing, said inertial member having a second fluid passage extending therethrough in selected fluid communication with said first fluid passage;

(c) an actuator secured to the inertial member, said actuator being extendable to said first fluid passage as the inertial member is moved toward the first end component;

(d) a valve disposed in the first fluid passage for controlling fluid flow from said source of pressurized fire retardant, said valve being movable to an open position by the actuator as the inertial member is moved toward the first end component;

(e) a nipple extending from the first end component, said nipple partially defining said first fluid passage and being sealingly and slidingly received by the second fluid passage when said inertial member moves to the first end component and (f) a rigid conduit secured to the inertial member in fluid communication with the second passage, said rigid conduit being reciprocally movable through the second end component as the inertial member moves through the predetermined range.

2. A fire extinguisher as recited in claim 1 wherein said vehicle includes an engine and further including means for directing fire retardant from said container to the engine of said vehicle upon the movement of said valve to an open position.

3. A fire extinguisher as recited in claim 2 wherein said vehicle includes a fuel tank and further including means for directing fire retardant from said container to the vicinity of the fuel tank upon the movement of said valve to an open position.

4. A fire extinguisher as recited in claim 2 or 3 wherein said directing means includes a perforated conduit communicating with said container through said valve.

5. A fire extinguisher as recited in claim 3 wherein said directing means includes a perforated conduit, said perforated conduit being wrapped around said fuel tank.

6. A fire extinguisher as recited in claim 5 wherein said actuator is a firing pin secured to said inertial member, said firing pin extending into said first fluid passage during at least a portion of the inertial member's range of movement within said housing.

7. An apparatus as recited in claim 6 further including a manual control arm secured relative to said housing, said manual control arm being operative to control movement of said inertial member.

8. An apparatus as recited in claim 7 wherein said container is threadably received by said first fluid passage.

9. An apparatus as recited in claim 8 wherein said valve is spring biased to a closed position and said firing pin is reciprocally movable with said inertial member to engage said valve and overcome said spring bias to open said valve.

* * * * *